United States Patent [19]

Van't Sant et al.

[11] Patent Number: 4,457,776

[45] Date of Patent: Jul. 3, 1984

[54] PROCESS FOR THE REMOVAL OF ARSENIC COMPOUNDS FROM TUNGSTEN OR MOLYBDENUM CONCENTRATES

[75] Inventors: Jan P. Van't Sant, Westervoort, Arjen Nieuwhof, Arnhem, both of the Netherlands

[73] Assignee: Shell Internationale Research Maatschappij B.V., Netherlands

[21] Appl. No.: 519,626

[22] Filed: Aug. 2, 1983

Related U.S. Application Data

[62] Division of Ser. No. 341,417, Jan. 21, 1982, Pat. No. 4,420,331.

[30] Foreign Application Priority Data

Feb. 12, 1981 [NL] Netherlands ..... 8100668

[51] Int. Cl.[3] ..... C22B 1/11; C22B 1/12; C01G 39/00; C01G 41/00

[52] U.S. Cl. ..... 75/6; 423/53; 423/61; 423/87; 423/593

[58] Field of Search ..... 75/6; 209/5; 423/53, 423/61, 87

[56] References Cited

U.S. PATENT DOCUMENTS 3,220,796 11/1965 Espinosa .
3,674,424 7/1972 Stanley et al. .
4,242,124 12/1980 Makipirtti .

FOREIGN PATENT DOCUMENTS 1161432 1/1964 Fed. Rep. of Germany .

OTHER PUBLICATIONS

Dorfler et al., "Journal of Metals", May 1981, pp. 48–54.

*Primary Examiner*—Herbert T. Carter
*Attorney, Agent, or Firm*—Jones, Tullar & Cooper

[57] ABSTRACT

A process for the removal of arsenic compounds from tungsten and/or molybdenum concentrates by selective extraction, characterized in that the concentrates are extracted with an aqueous solution of a ferric compound of a pH below 2.5 and a temperature of at least 60° C.

4 Claims, No Drawings

PROCESS FOR THE REMOVAL OF ARSENIC COMPOUNDS FROM TUNGSTEN OR MOLYBDENUM CONCENTRATES

This application is a division of application Ser. No. 341,417, filed Jan. 21, 1982 now U.S. Pat. No. 4,420,331.

The invention relates to a process for the removal of arsenic compounds from tungsten and/or molybdenum concentrates by means of selective extraction.

Arsenic compounds can in principle be removed from tungsten and molybdenum concentrates by means of well-known flotation techniques. However, the flotation means suitable therefor are poorly selective, that is to say, it is difficult to obtain a low arsenic content of for example 1500 ppm ore less in the purified concentrate without the simultaneous occurrence of a considerable loss of tungsten or molybdenum. An arsenic compound that is particularly difficult to remove is arsenopyrite (FeAsS). Whereas it is possible to remove loellingite ($FeAs_2$) from molybdenite with some success by means of conventional flotation agents—albeit not selectively—the latter fail to remove arsenopyrite.

It has surprisingly been found that highly efficient removal of arsenic from molybdenum concentrates is possible, and that even arsenopyrite can be removed in a substantially quantitative manner, if the concentrate is extracted with an aqueous solution of a ferric compound at a pH below 2.5 and a temperature of at least 60° C. Said extraction is found to be very selective, that is to say, there is no or practically no loss of molybdenum and it is moreover found to be usable in the same or similar manner for the removal of arsenic compounds from tungsten concentrates, in particular iron tungstate concentrates. In this case, too, the purification is found to be very selective.

The invention therefore relates to a process for the removal of arsenic compounds from tungsten and/or molybdenum concentrates by selective extraction, characterized in that the concentrates are extracted with an aqueous solution of a ferric compound at a pH below 2.5 and a temperature of at least 60° C.

The process according to the invention preferably serves to remove loellingite and arsenopyrite from molybdenite, to which end a ferric trichloride solution and an extraction temperature of at least 125° C. are used. Extraction with said solution comprises two different embodiments: (a) at a temperature above 140° C. and at elevated pressure, for example 110–600 kPa, and (b) at atmospheric pressure and at a temperature between 125° and 140° C. Application of atmospheric pressure makes it necessary to use rather high ferric trichloride concentrations in the extraction medium, that is to say concentrations above 4.5 mol./l, preferably concentrations between 5 and 8 mol./l, are used. In the other embodiment employing superatmospheric pressure, lower concentrations will suffice. In the latter case preference is given to values between 0.6 and 3.5 mol./l. Extraction conditions may be said to be stringent in both cases, in one case this is mainly the high ferric trichloride concentration, in the other case it is the elevated temperature. Said stringent conditions are particularly desirable in those cases where the intention is to remove the arsenopyrite present with an efficiency above 70%. In both preferred methods a $p_H$ between 0.1 and 1.0 is best maintained.

For the removal of arsenic compounds, particularly loellingite and/or arsenopyrite, from tungsten concentrates less stringent conditions will suffice. A strongly oxidizing extractant, for example ferric trichloride, can be used, but it is also possible to use the less strongly oxidizing ferric trisulphate instead. The extractant preferably used is a ferric trisulphate solution obtained in the preparation of iron tungstate concentrates by leaching tungstate ores that may also contain other iron compounds with concentrated sulphuric acids. This leaching causes an at least partly separation of iron compounds and tungstate, yielding solid products and an acid solution of iron sulphate. If the ferric content in said solution is too low, bivalent iron can be oxidized, for example with an oxygen- or chlorine-containing gas.

The removal of arsenic compounds from tungsten concentrates according to the process of the invention is preferably carried out at atmospheric pressure and at relatively low temperature, that is to say between 65° and 110° C. The iron compound concentration in the extractant is usually such that during extraction an iron concentration between 0.005 and 2 mol./l, preferably between 0.01 and 1 mol./l is set. The $p_H$ will usually be between 0 and 1.5.

The process according to the invention can very suitably be used in the processing of ores containing molybdenite and iron tungstate and further, as impurities (0.1–5% by wt), loellingite and arsenopyrite and possibly other impurities. To this end the ore is dressed in the following manner: by selective flotation the finely ground ore is split into two separate product streams, one of which contains the molybdenite and the other the iron tungstate. Various impurities, mainly heavy metals, are removed from the molybdenite stream by means of flotation, in which step a molybdenite concentrate is obtained to which the extraction method according to the invention is subsequently applied. The tungstate stream is first purified of a large part of the arsenopyrite present by means of flotation after which the purified tungstate concentrate is leached with a strong acid, such as sulphuric acid. Upon magnetic separation of the leaching residue the concentrate is formed to which the extraction method according to the invention is applied, in which treatment the remaining arsenopyrite and the loellingite present are removed in a substantially quantitative manner, so that the purified tungstate contains less than 2000 ppm, preferably less than 800 ppm of arsenic. The extraction of the molybdenite also proceeds very effectively; these concentrates also contain as a rule less than 800 ppm of arsenic after extraction. For said flotation steps and themagnetic separation any known suitable method can be used. Suitable flotation agents are commercially available and the selection thereof forms no part of this invention.

A preferred embodiment of this invention is therefore concerned with a process for removing loellingite and arsenopyrite from an ore comprising molybdenite and iron tungstate which comprises subjecting the ore in a finely ground state to selective flotation yielding a product stream basically comprising molybdenite and another product stream basically comprising iron tungstate, subjecting the molybdenite stream to flotation yielding a molybdenite concentrate comprising loellingite and arsenopyrite impurities, subjecting the molybdenite concentrate to extraction with an aqueous solution of a ferric compound at a $p_H$ below 2.5 and a temperature of at least 60° C. and recovering a purified molybdenite comprising less than 800 ppm of arsenic, subjecting the iron tungstate product stream to leaching with a strong acid, to lower the content of iron compounds in this product stream, subjecting the leached product stream to magnetic separation yielding an iron tungstate concentrate having a reduced iron content and a solution of an iron salt, subjecting the iron tungstate concentrate to extraction with an aqueous solution of a ferric compound at a $p_H$ below 2.5 and a temperature of at least 60° C. and recovering a purified iron tungstate comprising less than 2000 ppm of arsenic.

Another preferred embodiment of this invention is concerned with a process for removing loellingite and and arsenopyrite and other impurities from an ore comprising molybdenite which comprises subjecting the ore in a finely ground state to flotation in order to selectively remove apart of the loellingite, arsenopyrite and other impurities, yielding a product stream basically comprising partially purified molybdenite, subjecting the partially purified molybdenite product stream to flotation yielding a molybdenite concentrate having a reduced content of loellingite and arsenopyrite impurities, subjecting the molybdenite concentrate to extraction with an aqueous solution of a ferric compound at a $p_H$ below 2.5 and a temperature of at least 60° C. and recovering a purified molybdenite comprising less than 800 ppm of arsenic.

Another preferred embodiment of this invention is concerned with a process for removing loellingite and arsenopyrite and other impurities from an ore comprising iron tungstate which comprises subjecting the ore in a finely ground state to flotation in order to selectively remove apart of the loellingite, arsenopyrite and other impurities, yielding a product stream basically comprising partially purified iron tungstate, subjecting the iron tungstate product stream to leaching with a strong acid to lower the content of iron compounds in this product stream, subjecting the leached product stream to magnetic separation yielding an iron tungstate concentrate having a reduced iron content and a solution of an iron salt, subjecting the iron tungstate concentrate to extraction with an aqueous solution of a ferric compound at a $p_H$ below 2.5 and a temperature of at least 60° C. and recovering a purified iron tungstate comprising less than 2000 ppm of arsenic.

In the above-described methods for dressing ores, comprising iron tungstate, during the strong acid, preferably sulphuric acid leaching of the tungstate stream, an acid solution is obtained containing a ferrous or ferric salt, preferably ferric sulphate. After optional oxidation and optional concentration or dilution, if desired, the iron sulphate solution can very well serve as extractant for the purification of the tungstate stream according to the invention. In this manner an integrated process is formed that does not use separate iron sulphate, which is an important advantage.

The extraction method of the present invention on the one hand results in a purified solid substance that can easily be separated from the liquid and subsequently be washed, and on the other hand in a solution of iron and arsenic compounds. In this solution an excess of iron used will still be present as trivalent iron, the remaining iron being mainly converted into bivalent iron.

Further, in the extraction of molybdenite or tungstate concentrates the use of iron compound can be limited by oxidizing the bivalent iron obtained to form trivalent iron, for example with a chlorine- or oxygen-containing gas. This regeneration can very suitably be carried out in situ during extraction or in a separate step. In the latter case the regenerated iron can be recycled to the extraction step. If such a regeneration is carried out with solutions that have been used for the extraction of molybdenite, foam formation can be reduced by oxidation with chlorine in intermittent operation in which the time during which chlorine gas is introduced is about 30–70% of the total reaction time. During the remaining time the introduction of chlorine is interrupted.

The process according to the invention is illustrated below with reference to the practical examples.

EXAMPLE 1

A thoroughly ground arsenic/molybdenum/tungsten ore containing 0.90% by wt of arsenic (loellingite 30%, arsenopyrite 70%), 0.20% by wt of molybdenite ($MoS_2$), 0.40% by wt of $WO_3$ (iron tungstate), 0.03% by wt of tin (cassiterite 70%, mawsonite 30%), 0.35% by wt of zinc (sphalerite) and about 0.22% by wt of remaining metals is separated by means of conventional stepped flotation and dressed into a molybdenite concentrate and a tungstate concentrate. To this end a first flotation step is carried out by means of a mixture of alkyldithiocarbonates (the commercially available products Z6 and Z200) and methylisobutylcarbinol. The flotation product is subsequently twice subjected to flotation with sodium hydrosulphide and after filtration a molybdenite concentrate with a moisture content of 15% by wt is obtained. The product remaining from the first step is conditioned with $H_2SiF_6$ and floated with a commercial fatty acid agent. The flotation product is again treated with $H_2SiF_6$ and subsequently extracted with sulphuric acid. After magnetic separation a tungstate concentrate with a solid matter content of 65% by wt is obtained.

Analysis of the molybdenite concentrate shows that 73.4% by wt of $MoS_2$, 3.0% by wt of iron, 1.7% by wt of arsenic, 0.06% by wt of tin, 0.35% by wt of zinc, 0.23% by wt of tungsten and about 3.0% by wt of other metals are present. The contents in the tungsten concentrate are 67.8% by wt of $WO_3$, 0.2% by wt of molybdenum, 15.9% by wt of iron, 2.6% by wt of arsenic, 0.5% by wt of tin, 0.12% by wt of zinc and about 0.10% by wt of other metals.

EXAMPLE 2

The molybdenite concentrate obtained in Example 1 was diluted with water until the solid matter concentration was 100 g/l and the $p_H$ was 0.8. Subsequently, $FeCl_3$ was added in such a quantity that its concentration in the reactor was set at 6 mol./l. The mixture was stirred for 5 hours at atmospheric pressure at a temperature of 130° C. and subsequently filtered. The solid matter was thoroughly washed with a solution of 1 mol./l of HCl and subsequently with water and analyzed for content of arsenic compounds; a quantity of 400 ppm of arsenic was found.

EXAMPLE 3

The test of Example 2 was repeated at a solid matter concentration of 200 g/l and a reaction time of 8 hours, the other conditions remaining unchanged. An arsenic content of 500 ppm was found.

EXAMPLE 4

The test of Example 2 was repeated at a solid matter concentration of 300 g/l; the mixture was now stirred for eight hours, the other conditions remaining unchanged. An arsenic content of 600 ppm was found.

EXAMPLE 5

Repetition of the test of Example 2 at 100° C., the other conditions remaining unchanged, resulted in a final arsenic content of 600 ppm.

EXAMPLE 6

At a solid matter concentration of 200 g/l of molybdenite, a $p_H$ of 0.8 and a temperature of 150° C., an $FeCl_3$ concentration of 3 mol./l was now set. The suspension was subsequently stirred for 5 hours at a pressure of 260 kPa. After filtration and washing the molybdenite had an arsenic content of 400 ppm.

EXAMPLE 7

Repetition of the test of Example 6 at solid matter concentrations of 300 and 400 g/l resulted in a final arsenic content of 600 and 1500 ppm respectively.

EXAMPLE 8

Repetition of the test of Example 6 at $FeCl_3$ concentrations of 2 and 1 mol./l gave a final arsenic content of 700 ppm. At the 1 mol./l concentration the mixture was stirred for 8 hours instead of 5.

EXAMPLE 9

The filtrate obtained in the test of Example 2 was regenerated at a temperature of 100° C. for 5 hours by blowing through oxygen at a rate of 45 Nl/l/h. It was found that in this treatment the concentration of bivalent iron fell from 64 to 25 g/l. The oxidized filtrate was subsequently used as $FeCl_3$ solution in the manner described in Example 2, after make-up with fresh $FeCl_3$ until the concentration thereof in the reactor was 6 mol./l and after discharge of 15% by wt of the oxidized filtrate. Here again a final arsenic content of 400 ppm obtained.

EXAMPLE 10

The $FeCl_2$ solution was now regenerated in situ during the extraction of the molybdenite instead of thereafter. To this end chlorine gas was introduced at a rate of 6 Nl/l/h for 4 hours from half an hour after the beginning of the extraction according to Example 3. The concentration of bivalent iron was measured at the beginning and at the end of the reaction with chlorine. It was found that said concentration had decreased from 52 to 8 g/l. There was no foam formation during the regeneration. The final arsenic content in the molybdenite was a constant 500 ppm.

EXAMPLE 11

The tungstate concentrate obtained as described in Example 1 was diluted with water until the solid matter concentration was 100 g/l. The $p_H$ was then 0.8. The material was stirred at a temperature of 70° C. for two hours in the presence of added $Fe_2(SO_4)_3$, the concentration thereof in the reactor being 0.04 mol./l. After filtration and washing an arsenic content of 620 ppm was measured in the solid matter. Repetition of this test at a temperature of 50° C. and an $Fe_2(SO_4)_3$ concentration of 0.2 mol./l resulted in a final arsenic content of 1500 ppm.

We claim:

1. A process for removing loellingite and arsenopyrite and other impurities from an ore comprising iron tungstate which comprises subjecting the ore in a finely ground state to flotation in order to selectively remove a part of the loellingite, arsenopyrite and other impurities, yielding a product stream basically comprising partially purified iron tungstate, subjecting the iron tungstate product stream to leaching with a strong acid to lower the content of iron compounds in this product stream, subjecting the leached product stream to magnetic separation yielding an iron tungstate concentrate having a reduced iron content and a solution of an iron salt, subjecting the iron tungstate concentrate to extraction with an aqueous solution of a ferric compound at a pH below 2.5 and a temperature of at least 60° C. and recovering a purified iron tungstate comprising less than 2000 ppm of arsenic.

2. A process as claimed in claim 1, in which the ferric solution used for extracting the iron tungstate concentrate is a solution of ferric trisulphate.

3. A process as claimed in claim 2, in which the ferric trisulphate solution used for extracting the iron tungstate concentrate is obtained by employing sulphuric acid as the strong acid in the leaching of the iron tungstate product stream.

4. A process as claimed in claim 3, in which the ferric solution also comprises ferrous sulphate and the solution is oxidized to increase the content of trivalent iron therein.

* * * * *